United States Patent [19]

Lindstrom et al.

[11] Patent Number: 4,871,027

[45] Date of Patent: Oct. 3, 1989

[54] MULTIPLE-EDGE SOD CUTTER FOR VIBRATORY PLOW

[75] Inventors: Edgar K. Lindstrom; Marvin L. Morris, both of Wichita, Kans.

[73] Assignee: J. I. Case Company, Racine, Wis.

[21] Appl. No.: 216,068

[22] Filed: Jul. 7, 1988

[51] Int. Cl.[4] ..... E02F 5/02; F16L 1/00

[52] U.S. Cl. ..... 172/40; 172/165; 172/735; 405/182

[58] Field of Search ..... 172/40, 735, 165, 702, 172/703, 704, 725, 737; 405/180, 181, 182, 183

[56] References Cited

U.S. PATENT DOCUMENTS

| | | | |
|---|---|---|---|
| 100,957 | 3/1870 | Wheatley | 172/704 |
| 212,419 | 2/1879 | Aldrich | 172/735 |
| 2,812,731 | 11/1957 | Gardner | 172/735 X |
| 3,173,272 | 3/1965 | Knapp et al. | 405/183 |
| 3,295,333 | 1/1967 | Killoren | 405/183 |
| 3,363,423 | 1/1968 | Davis | 172/40 X |
| 3,618,237 | 11/1971 | Davis | 172/40 X |
| 4,040,261 | 8/1977 | Schuck et al. | 172/40 X |
| 4,200,410 | 4/1980 | Baker et al. | 172/40 X |
| 4,245,705 | 1/1981 | Morita et al. | 172/40 X |

OTHER PUBLICATIONS

John Deere, 235, "Cable Plow", Operator's Manual, Nov. 1962.

*Primary Examiner*—Richard J. Johnson
*Assistant Examiner*—Jeffrey L. Thompson
*Attorney, Agent, or Firm*—Dykema Gossett

[57] ABSTRACT

A vibratory plow including a cutter assembly which slices the ground covering and breaks the sod ahead of the cable-laying plow blade. The plow assembly includes a blade holder that is pivotally mounted to a vibrator frame. A mounting member attaches the cutting blade of the cutter assembly to the blade holder. The cutting blade is polygonal in shape and includes a plurality of mounting holes located in polygonal patterns. The mounting member includes a complementary set of mounting holes also arranged in a polygonal pattern. The present construction permits the cutting blade to be moved to a plurality of cutting positions rather than replacing the cutter after a cutting edge is worn.

1 Claim, 2 Drawing Sheets

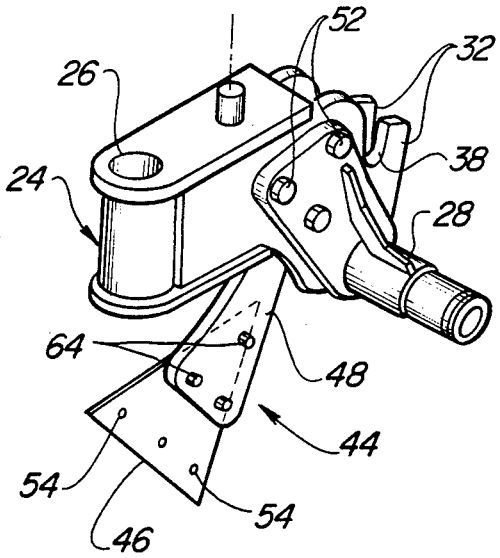
Fig-2
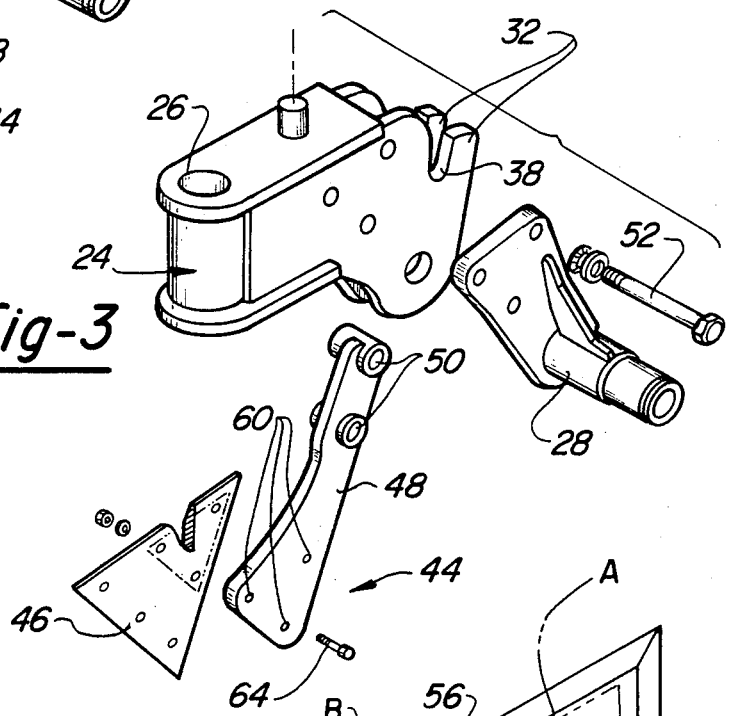
Fig-3
Fig-4
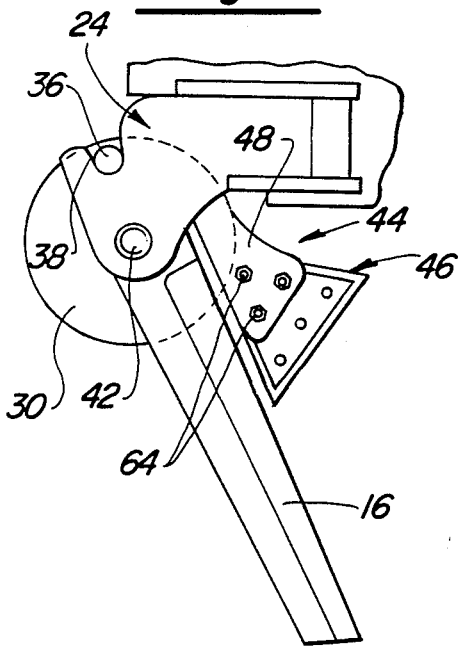
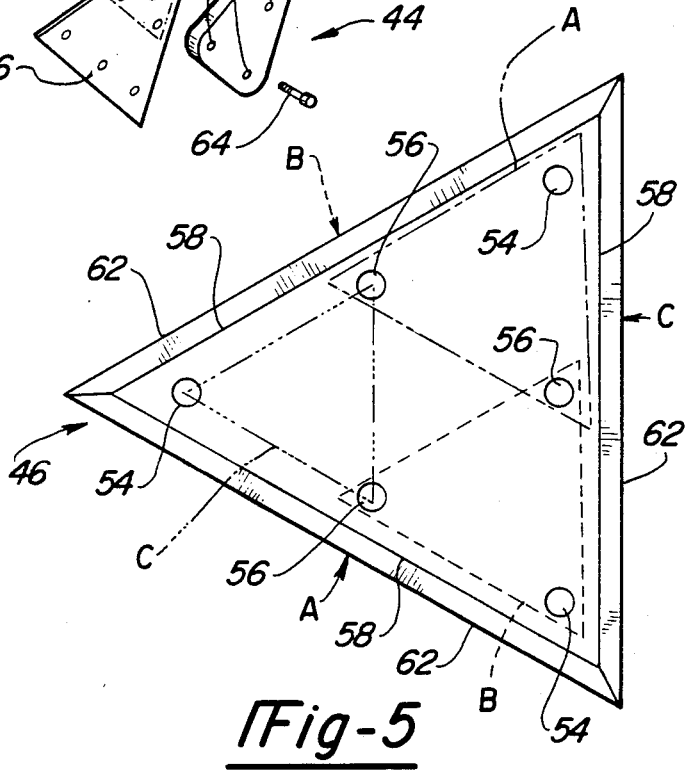
Fig-5

MULTIPLE-EDGE SOD CUTTER FOR VIBRATORY PLOW

BACKGROUND OF THE INVENTION

The present invention relates generally to a vibratory plow which is adapted to lay cable, flexible pipe, and the like underground in the cut made by a blade wherein the blade is vibrated to reduce the force required to pull the blade through the ground. More particularly, the present invention relates to a vibratory plow assembly having a multiple-edge sod cutter which slices the thatch or ground covering and breaks the sod ahead of the plow blade.

Vibratory cable plows have been used for several years to lay cable, flexible pipe, and the like underground. The cable or pipe may be either pulled through the cut of the plow blade, or a cable chute may be provided on the trailing edge of the plow blade which guides the cable or pipe into the ground from a drum mounted on the tractor or other vehicle. Various types of vibrators have been mounted on the plow blade, or the vibrator and blade have been suspended together on a resilient frame assembly to generate either vertical or orbital motion in the plow blade. Examples of such prior art vibratory plows are disclosed in U.S. Pat. Nos. 4,040,261, 3,618,237 and 3,363,423, all assigned to the assignee of the present invention.

A preferred frame assembly of prior art vibratory plows, as shown in the above-referenced patents, includes two pairs of parallel side links which are resiliently supported by pivotal connections to forward and rearward frame members comprising generally vertical stanchions or columns. The plow blade and vibrator are supported by the rearward frame member. The vibrator generates substantially vertical vibrations in the plow blade when the vehicle is stationary and orbital vibration in the blade as the blade is pulled through the ground.

In vibratory plow constructions of the type just described, it is often advantageous to slice the thatch or ground covering and break the sod which precedes the cable-laying plow blade. This prevents grass, weeds, and other debris from wrapping about the skid shoes or plow blade, thereby making the plowing more efficient.

In known sod cutter constructions, a single cutting edge has been used to slice the thatch and break the sod ahead of the plow blade. However, since the single cutting edge wears rapidly and loses its sharpness, thereby becoming less efficient, it must be changed and replaced frequently. Thus, there has been a need for an improved sod cutter that eliminates the disadvantages and limitations of known constructions.

It is, therefore, a principal object of the present invention to provide a sod cutter construction which does not require frequent sharpening or replacement. Further, it is an object of the present invention to provide improved slicing of the thatch or ground cover and breaking of the sod that precedes the cable-laying plow blade.

SUMMARY OF THE INVENTION

The vibratory plow assembly of this invention is adapted to lay an elongated element such as a cable or flexible pipe underground in the cut made by the plow blade. The assembly includes a resilient plow frame for mounting the plow on a ground-traversing vehicle, such as a tractor, bulldozer, or the like. The preferred frame assembly includes a forward frame member, laterally spaced side frame members, and a rearward frame member which supports the elongated cable plow and the vibrator. The side frame members preferably comprise a pair of generally vertically spaced elongated links which converge in spaced relation toward each other. The forward and rearward ends of each link are pivotally connected to the forward and rearward frame members.

The vibratory plow blade is mounted to a blade and gage wheel holder. The holder is pivotally mounted to the vibrator frame to permit rotational movement by the holder and blade about a vertical axis when the plow assembly is moved to an outboard or lateral position for offset trenching. The holder also includes axle shafts for mounting gage wheels and spaced apart hanger arms for advantageously assisting in the mounting of the blade.

The sod and debris cutter of the present invention includes multiple cutting edges and multiple cutting positions. The blade, which is generally an equilateral triangle in shape, includes a mounting hole pattern wherein holes are provided at each of three corners and at the midpoint of each side. A blade-mounting member is provided which includes a three-hole triangular pattern for the purpose of matching one corner hole and the midpoint holes along the adjacent sides of the cutting blade. This construction provides six positions of the cutter blade wherein the blade is either turned over or rotated 120 degrees or both during each changeover. Thus, when one cutting edge of the blade is worn, the blade is moved to another one of its six possible positions rather than being replaced.

The present construction provides a sod cutter having three cutting edges and six cutting positions, all within one blade. Further, the mounting frame for the blade provides a stable and improved positioning of the blade for slicing the ground and breaking the sod ahead of the plow blade. Other advantages and meritorious features of the present invention will be more fully understood from the following description of the invention, the appended claims and drawings, a brief description of which follows.

BRIEF DESCRIPTION OF THE DRAWINGS

FIG. 2 is a perspective view of the sod cutter of the present invention in its mounted position.

FIG. 3 is an assembly drawing of the cable plow blade holder and sod cutter.

FIG. 4 is a side elevational view of the cable plow blade, the cable plow blade holder, and the sod cutter.

FIG. 5 is a side elevational view of the sod cutter blade.

DETAILED DESCRIPTION OF THE INVENTION

Figure 1:
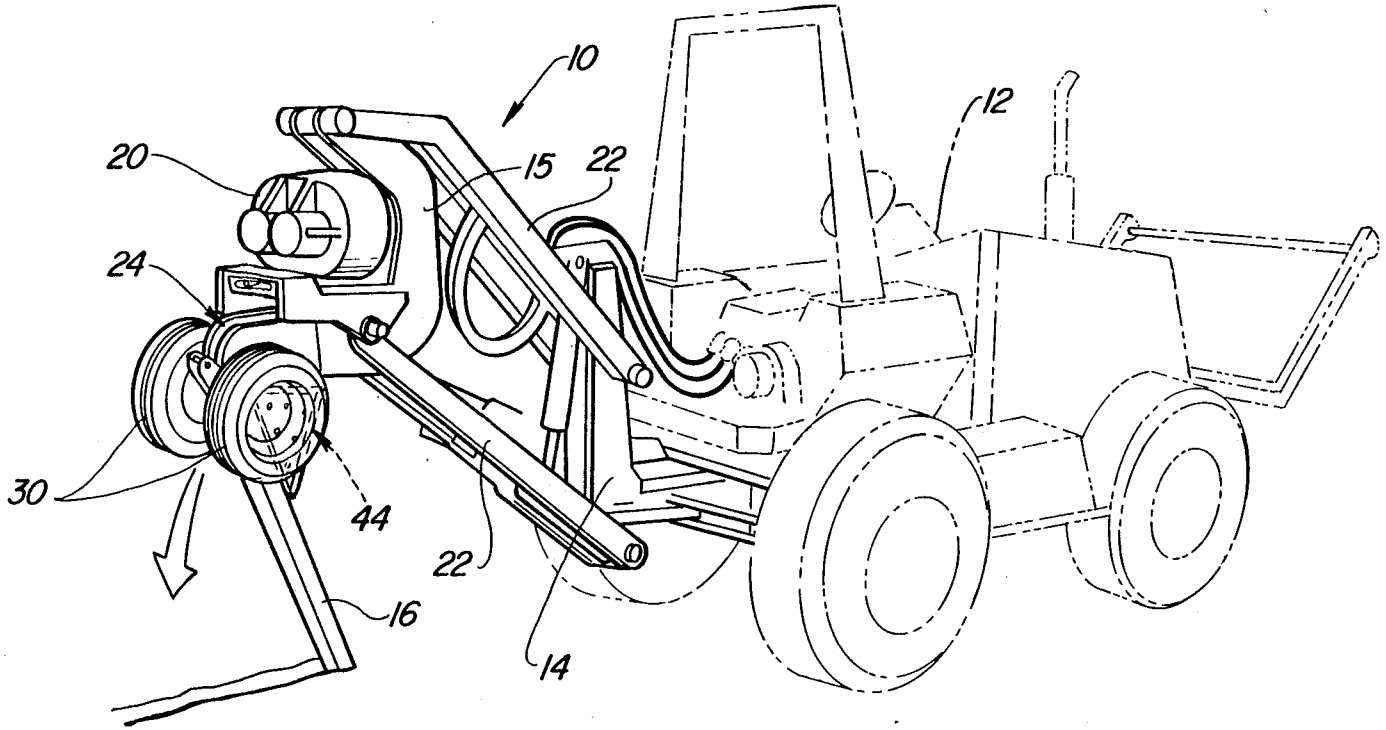
FIG. 1 is a side perspective view of a tractor and vibratory cable-laying plow made in accordance with the teachings of the present invention.

Referring to FIG. 1, a vibratory plow assembly 10 made in accordance with the teachings of the present invention is connected to the rear of vehicle 12, which may be a tractor, bulldozer, or the like. Generally, the vibratory plow assembly 10 includes a vertical mast assembly 14 which is attached to the rear of vehicle 12, a vertical shaker frame 15, and a plow blade 16. Blade 16 may include a cable guide (not shown) supported thereon for receiving a cable which is continuously fed into and along the bottom of the ground slot formed by blade 16, as is conventional.

Shaker frame 15 has a power-driven oscillating mechanism 20 supported thereon for reciprocating blade 16 vertically between upper and lower limits. Shaker frame 15, oscillating mechanism 20, and blade 16 are suspended from mast assembly 14 by upper and lower pairs of connecting links 22. As is conventional, the oscillating mechanism 20 is adapted to vibrate blade 16 and thereby transmit an arcuate or orbital motion to the blade.

Referring to FIGS. 2-5, the plow blade assembly 10 and associated structure of the present invention are shown in greater detail. Plow blade 16 is mounted to a plow blade and gage wheel holder 24. Holder 24 is pivotally mounted to shaker frame 15 by a pin (not shown) which is inserted through opening 26 (FIG. 3) to permit rotational movement by holder 24 and blade 16 about a vertical axis when the plow assembly 10 is moved to an outboard or lateral position for offset plowing. Holder 24 also includes axle shafts or bearing members 28 for mounting gage wheels 30. Moreover, holder 24 includes spaced apart hanger arms 32 (FIG. 2) for advantageously assisting in the mounting of plow blade 16.

Blade 16 is mounted between hanger arms 32 such that its upper end is supported by pin 36 (FIG. 4) between opposed slots 38, and a lower portion of blade 16 is supported by pin 42 which extends through hollow axle shafts 28. This construction improves the mounting of the plow blade 16 and optimally locates blade 16 relative to gage wheels 30.

Blade 16 is mounted on holder 24 by inserting the blade mounting pin 36 in the upper end of blade 16, and then blade 16 is positioned between hanger arms 32 such that the opposed ends of pin 36 fit within the opposed slots 38, thereby permitting blade 16 to hang downwardly. Thereafter, blade 16 can be maneuvered easily so that the lower mounting pin 42 may be inserted through the opposed axle shafts 28, thereby providing for considerable ease in mounting plow blade 16. Moreover, since the gage wheels 30 are mounted to holder 24 on the same center line or axis as lower mounting pin 42, the optimal location for the gage wheels 30 is provided.

The sod cutter assembly 44 of the present invention includes a blade 46 and a mounting member 48. Member 48 includes mounting openings 50 adjacent one of its ends. Member 48 is mounted between hanger arms 32 by using the fasteners 52 that secure bearing members 28 to holder 24. The sod cutting blade 46 is in the shape of an equilateral triangle. Further, blade 46 includes a plurality of triangularly-shaped hole patterns (see A, B, and C, FIG. 5). Holes 54 are located at the three corners of blade 46, and holes 56 are located at the midpoint of each blade side 58. The holes 54 and 56 in blade 46 are also arranged in a plurality of equilateral triangle patterns. Further, mounting member 48 includes three triangularly arranged holes 60 which match one corner hole 54 and two adjacent midpoint holes 56 in cutter blade 46.

Sod cutter blade 46 includes three beveled cutting edges 62 which are selectively rotated into a cutting position. At each cutting position, blade 46 is secured to mounting member 48 by inserting fasteners 64 through the holes 60 in member 48 and through one corner hole 54 and two adjacent midpoint holes 56 in blade 46. The blade 46 is either turned over or rotated 120 degrees or both during each change-over, thereby providing six possible cutting positions. Thus, after one of the blade edges 62 is worn, the sod cutter blade 46 is moved to a new position rather than replacing it. Moreover, the positioning of blade 46, mounting member 48, and the triangular mounting connections between blade 46 and member 48 provide for improved slicing and breaking of the sod which precedes the cable-laying plow blade 16.

It will be understood that the foregoing disclosure is exemplary in nature, and that various modifications may be made to this invention without departing from the appended claims.

We claim:

1. A vibratory plow assembly comprising:

a forward frame member connected to a vehicle, a rearward frame member, and spaced apart side frame members pivotally connecting said forward and rearward frame members to permit vertical movement of said rearward frame member relative to said forward frame member;

a vibrator mounted on said rearward frame member, a blade holder pivotally mounted to said rearward frame member for pivotal movement about a vertical axis, a cable-laying plow blade secured to said blade holder, and said vibrator operatively connected to said plow blade, said blade holder includes opposed hanger arms and said plow blade secured between said hanger arms, and said blade holder including opposed ground-engaging wheels on opposite sides of said plow blade; and a cutter assembly mounted to said blade holder at a location forward of said plow blade, and said cutter assembly including a cutting blade having multiple cutting edges and multiple cutting positions such that the cutting blade is selectively movable into a new cutting position when one of said cutting edges becomes worn;

wherein the cutting blade is polygonal in shape;

wherein the cutting blade includes a plurality of mounting openings which are arranged in a plurality of triangular patterns; and wherein the cutter assembly includes a mounting member for attaching said cutting blade to said blade holder, said mounting member attached to said blade holder between said hanger arms, and said mounting member includes a plurality of mounting holes which are arranged in a triangular pattern for mounting said cutting blade.

* * * * *